United States Patent [19]

Baumgartner

[11] 4,343,143

[45] Aug. 10, 1982

[54] BINDING FOR FIBER BUNDLES, A METHOD FOR THE PRODUCTION OF THE BINDING AND AN APPARATUS FOR CARRYING OUT THE METHOD

[75] Inventor: August Baumgartner, Uster, Switzerland

[73] Assignee: Zellweger, Ltd., Uster, Switzerland

[21] Appl. No.: 149,545

[22] Filed: May 13, 1980

[30] Foreign Application Priority Data

Sep. 28, 1979 [CH] Switzerland ..... 8784/79

[51] Int. Cl.[3] ..... B65H 69/06; B65H 69/00

[52] U.S. Cl. ..... 57/22

[58] Field of Search ..... 57/22, 261

[56] References Cited

U.S. PATENT DOCUMENTS

| | | | |
|---|---|---|---|
| 1,345,375 | 7/1920 | Lemay | 57/22 |
| 2,028,144 | 1/1936 | Cavanagh | 57/22 |
| 3,040,153 | 6/1962 | Seney | 57/22 |
| 3,654,756 | 4/1972 | Artamova et al. | 57/261 |
| 4,254,610 | 3/1981 | Pierce et al. | 57/22 |

*Primary Examiner*—Donald Watkins

*Attorney, Agent, or Firm*—Craig and Antonelli

[57] ABSTRACT

A binding for bundles of fibers in which fibers originating from at least one of the fiber bundles wind around the rest of the fibers in a manner locked by tension. Fiber bundles which are to be bound are deformed between deformation members and fibers are removed from at least one of the fiber bundles and are wound in a manner locked by tension around the remainder of the remaining pieces of fibers to be bound. Deformation members are positioned very close to each other, each having a profiled surface, and they can be driven in opposite directions with respect to each other. The fiber bundles which are to be bound are deformed in the gap between the deformation members.

45 Claims, 32 Drawing Figures

BINDING FOR FIBER BUNDLES, A METHOD FOR THE PRODUCTION OF THE BINDING AND AN APPARATUS FOR CARRYING OUT THE METHOD

BACKGROUND OF THE INVENTION

This invention relates to a binding for fiber bundles, a method for producing the binding and an apparatus for carrying out the method.

1. Field of the Invention

The term "fiber bundle" as used herein indicates a bundle of fibers, a yarn, or a ply yarn, a twine or a rope or a similar stretched structure of fibers or filaments which are brought together, in which both vegetable and animal, as well as synthetic, basic materials can be included. In the broadest sense, the invention relates particularly to the field of textiles and generally to the products of the textile industry; however, it is not restricted to this field.

2. Description of the Prior Art

The problem frequently arises, in the relevant manufacturing and processing industry, of binding two or more fiber bundles together. This problem has been solved exclusively for a long time by tying or knotting the free ends of the fiber bundles which are to be bound together in a manual or mechanical manner. This solution to the problem has proved to be extremely expedient and economical for many purposes. However, it should be appreciated that apparatus for mechanically joining such bundles with knots, that is, so-called automatic knotters or knotting apparatus, are relatively complicated mechanical devices, which are therefore also relatively expensive.

Binding fiber bundles, achieved by knotting, has the additional disadvantage for many application purposes that the knot which is produced necessarily has a much larger cross section than the individual fiber bundle itself. During the further processing of the knotted fiber bundle, for example, in weaving or knitting, this fact can have a detrimental effect and can cause the fibers to break or can cause other disturbances during production. Thus, suggestions have repeatedly been made to accomplish the binding of fiber material in a manner other than by knotting.

A process for splicing fibers by using a knotting device comprising an air nozzle is known from German Offenlegungsschrift No. 2,865,514. In such a device, one end of both the spun yarns or fibers is introduced from one side into a fiber inlet in the air nozzle of the knotting device and the other end is introduced into the inlet from the other side. By this means, both fibers are joined together and then at least one of the fibers is slightly loosened before or at the same time as the air is blown out onto the fibers.

Another process is known from German Offenlegungsschrift No. 2,750,913 for binding textile fibers by means of an apparatus comprising a whirling chamber having a longitudinal groove for inserting and removing the fibers to be bound. In this arrangement, the fibers, which are inserted so that they are lying next to each other and are held by a fiber clamping apparatus located outside the whirling chamber, are whirled together by the admission of compressed air and are bound together in this manner. The textile fibers which are to be bound are inserted into the whirling chamber so that they wind around both the edges of the openings of the whirling chamber. In this way, the textile fibers are subsequently whirled when they are slack and lying without tensile stress in the whirling chamber, being secured, however, by the fiber clamping apparatus, and the fiber tension is slackened only to such an extent that the false twist which is imposed while the textile fibers are being whirled and the shortening of the fiber length, being determined thereby, arranges the textile fibers against the edges of the opening of the whirling chamber.

Finally, Offenlegungsschrift No. 1,962,477 describes an apparatus for splicing yarns by using a rotating drum which is mounted on a casing element, the drum having a yarn groove running through the axis thereof for accommodating the overlapping ends of yarns to be spliced, which are arranged in adjacent parallel relationship to each other. The apparatus also uses devices for rotating the drum about the overlapping ends of the yarn to be spliced and devices carried by the drum for accommodating a source of winding fibers. A fiber groove is disposed in this drum adjacent to an outlet and is positioned radially with respect to the axis of this drum, whereby a larger moment is exerted on the winding fiber (which runs through the fiber groove) during operation when the fiber groove is rotated about the yarn.

Methods and apparatus in which a fluid, for example, compressed air, has to be blown into a whirling chamber, are complicated and troublesome, particularly because the fluid has to be admitted. They also form relatively-long binding points, which tend to produce difficulties during the processing of the bound fiber bundles mainly because of their length, but also because of their structure.

By using the solution to the problem proposed in the aforesaid German Offenlegungsschrift No. 1,962,477, relatively-firm bindings are, indeed, produced and the diameter of the binding point can be kept sufficiently small to facilitate the further processing thereof. However, in this solution, it is a fact that the binding point becomes relatively taut with regard to a normal fiber bundle and can thereby lead to difficulties in processing. The subsequent detachment of the winding yarn also necessitates an additional operating cycle to produce the product manufactured by use of bound yarns of this type. Difficulties can also arise in procuring suitable winding yarns for all possible fiber bundles to be processed.

BRIEF SUMMARY OF THE INVENTION

An object of the present invention is to produce a binding for fiber bundles without the disadvantages mentioned above, which, in particular, can be produced very quickly, for example, in the space of seconds, and which is also very flexible and has a binding diameter which does not deviate substantially from the diameter of the original fiber bundle and gives a high tearing strength.

It is a further object of the invention to produce a binding having no prominent features which hinder or encumber the further processing of the bound fiber bundles.

It is still another object of the invention to provide a method of producing a binding which may be carried out simply and quickly even by unskilled assistants or as part of an automatic process.

It is yet another object of the invention to provide an apparatus which may be produced simply and at low cost and permits the admission and removal of the fiber bundle in an uncomplicated, reliable and fast manner.

In contrast to the methods operating by the effect of a fluid, which partly require a great consumption of compressed air, and in contrast to those methods which operate on a purely mechanical basis and which temporarily apply a winding consisting of foreign material to the bundle, the binding forming the subject of the invention consists exclusively of material of at least one of the fiber bundles which are to be bound together, and only a very small consumption of energy is required for the mechanical processing of the fiber bundles at the binding point. By avoiding the admission of foreign material, no difficulties arise, for example, in the subsequent dyeing of products which are produced by using fiber bundles producing bindings of this type.

The binding as formed by this invention is based on the required displacement of elements of the fiber bundles to be bound, which fibers originating from at least one of the fiber bundles wind around the rest of the fibers of the bound fiber bundles in a manner locked by tension, over at least one part of the length of the binding.

A method for producing the binding according to this invention is characterized in that the fiber bundles which are to be bound together are first positioned so that they are at least approximately parallel to each other and lie very close to each other, then both thrust as well as tractive and/or pressure forces are exerted on at least one part of the circumference of each fiber bundle to be bound and on the entirety of the fiber bundles by physical contact of the bundles using agitated deformation members. This serves the purpose of changing the original cross sections and/or the structure of the fiber bundles to be bound and to loosen individual fibers of at least one of the fiber bundles to be bound at least partly from their bundle and to displace them so that they finally wind around the fiber bundles to be bound in a manner locked by tension at least in one part of the operational region of the deformation members. Subsequently, the fiber bundles which have been bound by the winding are relocated out of the operational region of the deformation members.

The invention also provides an apparatus for carrying out this method through the use of at least two spaced deformation members, which are movably mounted on a support, so that the deformation members or their contours can move relative to each other in the operational region on either side of the fiber bundles to be bound, means being provided for conveying the fiber bundles to the operational region and for conveying the bound fiber bundles from the operational region.

BRIEF DESCRIPTION OF THE DRAWINGS

The invention will now be described by way of example with reference to the accompanying drawings in which.

DETAILED DESCRIPTION OF THE PREFERRED EMBODIMENTS

Corresponding parts are identified by the same reference numbers in all the figures of the drawings, which figures are not drawn to scale.

Figure 1:
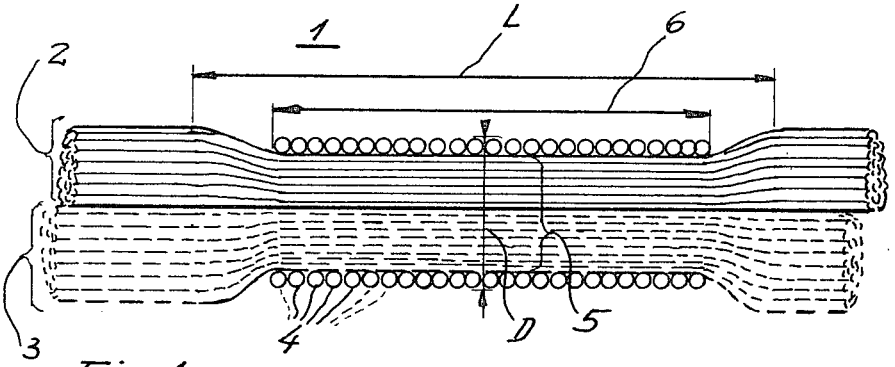
FIG. 1 is a schematic drawing which illustrates the binding of two fiber bundles.

FIG. 1 schematically shows a binding 1, which is formed of, for example, two fiber bundles 2 and 3. Substantially only the binding portion itself is shown and a short continuation of the bound fiber bundles 2 and 3 on either side thereof. The dead ends of the fiber bundles 2 and 3, which are bound together, may be cut off approximately at the ends of the binding length L when the binding operation is complete.

Fibers originating from within at least one of the fiber bundles 2 or 3 are wound around the fiber bundles to form a winding 4 at least over one part 6 of the length L of the binding 1. The remaining fiber material 5 of the fiber bundles 2 and 3 is therefore located inside the winding 4. This remaining fiber material is what is left over after the fibers which are required for the winding 4 have been at least partially removed from at least one of the fiber bundles 2 and 3 to be bound.

The remainder of the fibers 5 which are left inside the winding 4 correspond substantially to the total of the fibers which are present at the binding portion of the bound fiber bundles 2 and 3 before the bundles have been bound discounting the fibers which are used for the winding 4 in the winding region 6. It is important here to note that the cross section of the remaining material 5, that is to say, the total cross section of the fibers through the binding 1, is reduced to the extent of the fibers which are used for the winding 4, with regard to the total cross section of the original fiber bundles 2 and 3. However, in producing the binding 1, it is quite possible for a further quantity of fibers to be removed from at least one of the fiber bundles 2 and 3 to be moved away.

It is also important that the winding 4 is locked by tension, that is to say, that the fibers forming the winding 4 are connected in an effective adhesive manner with each other, and preferably, with the other fibers which have been wound around. In this way, the remaining fibers which have been wound around by the winding 4 of the fiber bundles 2 and 3, are held together substantially by at least the same compression as was the case in the original condition of the individual fiber bundles. Thus, there is obtained a tearing strength in the binding which is not substantially below the tearing strength of the individual fiber bundles, or is even the same or greater than this original tearing strength.

By removing more fibers from the fiber bundles 2 and/or 3 than those which are needed for the winding 4, the cross section of the material can be deliberately decreased in the region of the binding 1, in order to obtain both a smaller diameter D of the binding 1, and also to obtain a greater flexibility of the same binding 1. As a result of the high compression to which the remaining fibers 5 of the fiber bundles 2 and 3 lying inside the winding 4 are subjected, a tearing strength can be achieved in the binding 1 which, in spite of the decreased material cross section, is not substantially inferior to the tearing strength of an individual fiber bundle or is even at least equal to this.

Figure 2:
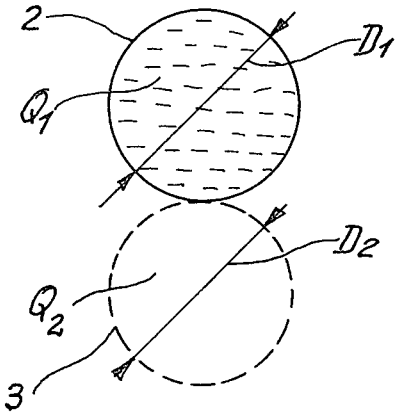
FIG. 2 is a schematic drawing which illustrates a relative position of two fiber bundles to be bound before they are bound.

FIG. 2 schematically illustrates a cross section through two adjacent fiber bundles 2 and 3. The first fiber bundle 2 has a diameter $D_1$ and a cross section $Q_1$ and the second fiber bundle 3 has a diameter $D_2$ and a cross section $Q_2$.

Figure 3:
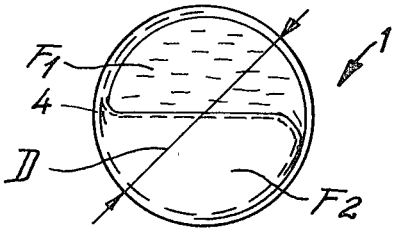
FIG. 3 is a cross section through a binding having a first structure.

FIG. 3 schematically illustrates a first cross sectional configuration of a binding 1, from which it can be seen that the originally-circular cross sections $Q_1$ and $Q_2$ have been reshaped into smaller formations $F_1$ and $F_2$ in the winding region 6, these reformed cross sections having an approximately semicircular or sector shape. The fiber bundles which have been deformed in this manner lie next to each other approximately along their diameter and produce a unified binding structure.

Figure 4:
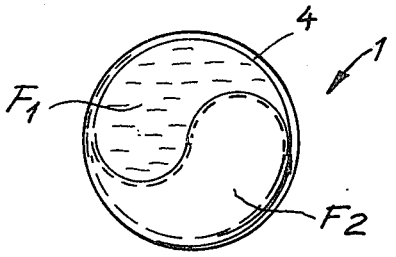
FIG. 4 is a cross section through a binding having a second structure.

FIG. 4 illustrates a second cross-sectional configuration of the binding 1, which can be achieved by a suitable choice of the deformation parameters. Here, the areas $F_1$ and $F_2$ partially wind around each other, so that an inner contact is produced between the two deformed cross sections of the fiber bundles which are pressed together.

Figure 5:
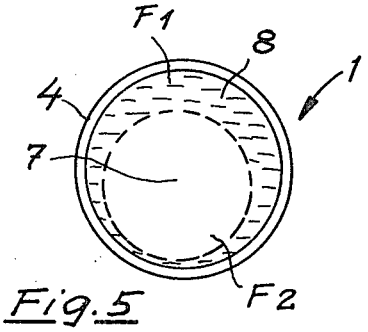
FIG. 5 is a cross section through a binding having a third structure.

FIG. 5 shows a third cross-sectional configuration of the binding 1, which can be obtained by a suitable choice of deformation parameters. This third structure is characterized by the fact that a core zone 7 and a sheath zone 8 are formed within the winding 4, and are enclosed by winding fibers 4. The core zone 7 consists substantially of fibers of one of the fiber bundles and the sheath zone 8 consists substantially of fibers of the other fiber bundle. In this regard, the core zone 7 can lie symmetrically or asymmetrically within the sheath zone 8.

Figure 6:
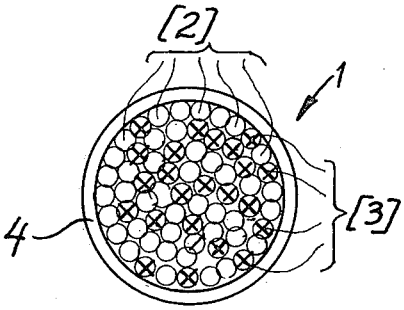
FIG. 6 is a cross section through a binding having a fourth structure.

FIG. 6 illustrates a fourth cross-sectional configuration of the binding 1, which is characterized by the fact that the fibers of the fiber bundle 2 (they are shown in FIG. 6 by a clear circle) and the fibers of the fiber bundle 3 (these are shown in FIG. 6 by a circle with a cross) are mixed together at least partially by the action of the deformation members, and are enclosed by the winding 4 as a mixed bundle. This structure is outstanding due to an increased adhesion of the fibers belonging to the individual fiber bundles.

Another increase in the adhesion of fibers, both with respect to those in the bound fiber bundles, as well as of the fibers lying in the winding 4, can be achieved by intentionally changing the internal and/or surface structure of at least one part of the fibers in the region of the binding 1 with respect to their condition before binding. These structural changes in the fibers may be accomplished, prior to binding, by deformation members and, for example, by forming the deformation members in a corresponding manner, as will be described in greater detail hereinafter. The change of the structure and/or the surface structure is preferably carried out in the sense of increasing the adhesion, for example, by roughening the surface of the fibers and/or by impressing waves or crimps on the individual fibers, prior to binding or during the binding operation, or both.

It is therefore possible that the length of the individual fibers within the binding 1 is shortened with respect to the length of the individual fibers outside the binding.

In the region of the binding 1, the number of the individual fibers which appear in at least one cross section through the binding 1, can be smaller than the original total of the fibers of the bound fiber bundles.

The diameter D of the completed binding 1 can be smaller than that of the diameter of a circle having an area which is the same as the total of the original cross sections of the individual bound fiber bundles.

Figure 7:
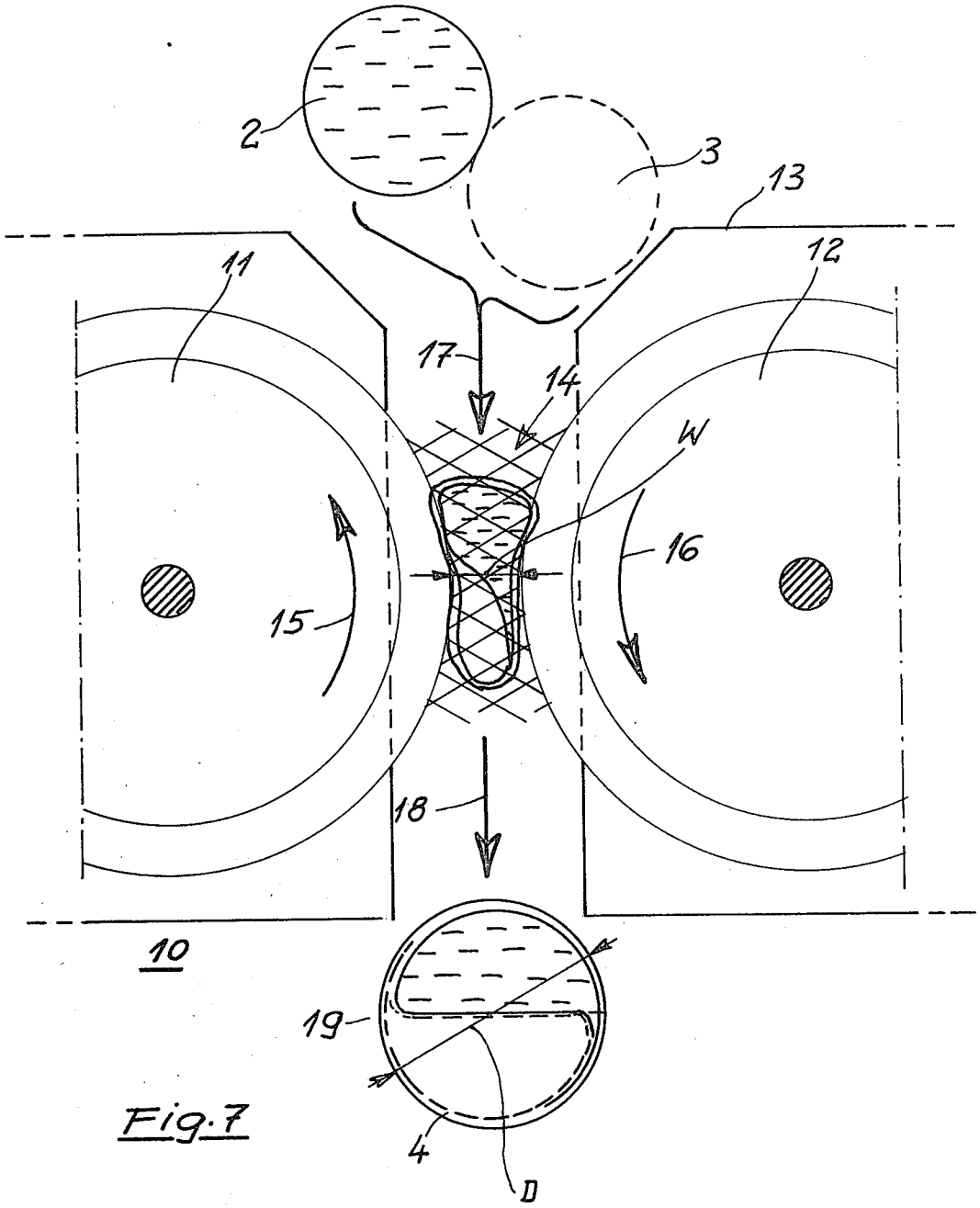
FIG. 7 is a schematic drawing which illustrates the production of the binding.

FIG. 7 schematically shows the basic method by which the production of the binding is carried out. The two fiber bundles 2 and 3 are conveyed in substantially-parallel, side-by-side relationship to each other in the direction of the arrow 17 toward and into a gap 14 between two deformation members 11 and 12. The deformation members 11 and 12 are not in contact with each other but are spaced by a suitable distance to leave a free width W in the form of the gap 14 at the narrowest point between the deformation members 11 and 12. The deformation members 11 and 12 are suitably driven so as to rotate in the direction of the arrows 15 and 16, respectively, with the result that their peripheries rotate in opposite directions.

The two fiber bundles 2 and 3 are deformed and compressed in the operation region inside the gap 14, shown in FIG. 7 as a cross-hatched section, as a result of the action of the deformation members 11 and 12 thereon. Moreover, individual fibers of at least one of the two fiber bundles 2 and 3 are drawn out, at least partially, from one or both of the bundles 2 and 3 and are drawn around the bundle by the bilateral rotative movement of the deformation members 11 and 12 to form the winding 4. When the deformed fiber bundles have left the operative region of the gap 14 in the direction of arrow 18, they have a cross section 19, which is substantially circular. The resulting cross-sectional area is smaller than the total or sum of the individual cross sections of the fiber bundles 2 and 3 before they entered into the operational region 14.

The configuration of the cross section 19 can be that of any one of those examples shown in FIGS. 3, 4, 5 and 6, or it can also be a mixture of these examples. Structural differences as illustrated in the embodiments of FIGS. 3 to 6 are produced particularly according to the type both of the starting material and of the processing, e.g., spinning, and of the number of windings of the fiber bundles per unit of length. Changes in the distribution within the fiber bundles with respect to the original distribution before the operation of the deformation members thereon result from the construction of the deformation members and/or the strength and/or frequency of the force applied at least on parts of the fiber bundles to be bound, as well as other factors. The tearing strength of the binding is also improved by this.

An advantageous development of the process in accordance with this invention consists in making at least one operational parameter variable and/or adjustable for the production of the binding, in order to promote the production of preferred binding structures, as they have been explained, for example, in FIGS. 3 to 6; and, by a certain choice of individual parameters of this type and/or of certain combinations of parameters of this type, structure having mixed shapes according to FIGS. 3 to 6 can also be produced. Such constructions and mixed shapes can be obtained, when, as an operational parameter, one or more of the following operation parameters is or are variable and/or adjustable:

1. The distance between the fixing points of the fiber bundles to be bound.
2. The tension between the fixed fiber bundles.
3. The structure of the deformation members.
4. The spacing between the deformation members.
5. The mutual spatial orientation of the deformation members.
6. The pressure of the deformation members on the fiber bundles to be bound.
7. The velocity of the deformation members relative to the fiber bundles.
8. The angled position of the deformation members or of their direction of movement relative to the fiber bundles.
9. The passage rate and/or passage time and/or duration of the fiber bundles to be bound through or in the operational region of the deformation members.

It is to be noted here that the choice of the distance between the fixing points of the fiber bundles to be bound from each other and from the operational region 14 (FIG. 7) influences the resulting balance of variations in the twist during and after the production of a binding, and thus ought to be adjusted advantageously. The adjustment of the longitudinal tension of the fixed fiber bundles which are to be bound together also has an analogous effect.

The spacing of the deformation members, and therefore, the width W of the deformation region or gap 14 (FIG. 7) has an influence on the structure of the binding, which is also dependent on the diameters $D_1$ and $D_2$ of the fiber bundles 2 and 3 to be bound, on the deformation forces and on the preference of the various configurations in accordance with the FIGS. 3 to 6.

The spatial arrangement, that is, the bilateral spatial orientation of the deformation members to each other and relative to the fiber bundles to be bound, for example, whether the main planes of the deformation members are at a right angle to the direction of the fiber bundles or whether they are inclined thereto in the same or a differing mass, also influences the resulting structure of the produced binding. The deformation members can also be directed against the fiber bundles to be bound by using more or less pressure, whereby the resulting structure of the produced binding is likewise influenced.

The deformation members rotate in opposite directions in the operational region 14 in the example shown in FIG. 7. The circumferential velocities of the deformation members are therefore chosen to be preferably approximately in the range of from 2 to 20 m/second. Where there are toothing profiles of the contours of the deformation members in the operational region for the fiber bundles to be bound, there results therefrom advantageous time intervals with a pressure influence on the fiber bundles of approximately 0.1 milliseconds and time intervals for the temporary release of the fiber bundles of approximately 0.2 milliseconds, when the fiber bundles 2 and 3 are conveyed through the gap 14 for an advantageous period of time of approximately from 0.5 to 2 seconds.

By positioning the deformation members transversely to the longitudinal direction of the fiber bundles to be bound, thrust forces with force components in the longitudinal direction of the fiber bundles can be achieved, resulting in an additional promotion for mixing the fibers of the individual fiber bundles.

It is also possible to influence the resulting structure within the binding by the choice of a suitable passage rate and/or passage time or duration of the fiber bundles to be bound through or in the operational region 14 of the deformation members.

As a result of the very complicated and partly-interconnected influences of the applicable parameters which have been mentioned above, and the relations for the production of a binding, both a certain choice of parameters and a certain choice of adjustments can best be found in an empirical manner. This procedure is advantageous and leads to an optimum operational method within the shortest time owing to the fast working method and the good reproducibility thereof.

It is also possible to produce a binding both when the fiber bundles to be bound are conveyed through the operational region 14 at an approximately-constant velocity, and also when the fiber bundles to be bound are kept in an approximately-constant position for a certain duration within the operational region 14.

It should be noted that the forces exerted by the deformation members on the fiber bundles to be bound vary in a fast temporal sequence, in their size and/or direction, and as a result of the structure of the surfaces of the deformation members 11 and 12 which come into contact with the fiber bundles. Time intervals are produced for the action of the deformation members with a variable force effect, including time intervals of the at least occasional release of the fiber bundles due to the construction of the deformation members in a fast temporal sequence or with a fast transition during the passing time or duration of the fiber bundles 2 and 3 to be bound through or in the operational region 14 of the deformation members 11 and 12.

A mixing of the fibers of one fiber bundle with fibers of the same and/or of another fiber bundle also results from the effect of the deformation members. This mixing of fibers increases the tearing strength of the binding.

As a result of the effect of the deformation members on the individual fibers of the fiber bundles to be bound, their surface and/or structure is changed so that there is an increase in adhesion, and the adhesion of fibers to one another in the region of the binding 1 which is to be produced is thereby increased with regard to parts of the fiber bundles which do not pass into the operational region 14 of the deformation members 11 and 12. This again improves the tearing strength of the binding.

The winding 4, being locked by tension on the binding 1, leads to an increase of the compression of the individual fibers in the region of the winding 4 within the remaining fibers 5 of the fiber bundles 2 and 3 to be bound, and thereby leads to an increased adhesion of the individual fibers, thereby again increasing the tearing strength of the binding 1.

Finally, by provision of a suitable structure as, for example, fine ribs, on the casing surfaces of the deformation members 11 and 12, the result can be that at least individual fibers of the fiber bundles 2 and 3 vary in their structure, for example, are waved, coiled or crimped, and they are thereby inclined to entwine with each other. If the remaining fibers 5 (FIG. 1) entwine, then the tearing strength of the binding 1 is thereby increased. If mainly the fibers in the region of the winding 4 entwine, then the tensional-locking of the winding is thereby improved, which is also an advantage for the quality of the binding 1.

FIG. 7 also schematically shows the apparatus for performing the method of production of the binding in a schematic illustration of the principles of the present invention. The apparatus 10 has at least the two deformation members 11 and 12 mounted on a support 13 so that they are movable; in the example of FIG. 7, they can rotate. The deformation members 11 and 12 are positioned so that their contours approach each other in an operational region of the gap 14 wherein they engage the fiber bundles 2 and 3 to be bound, without, however, actually touching each other. At the narrowest point between the deformation members 11 and 12 rotating in the direction of the arrow 15 or 16, the gap 14 which lies between the deformation members has a width W. The fiber bundles 2 and 3 to be bound can be conveyed in the direction of the arrow 17 to the operational region 14 approximately parallel to each other. By means of the deformation process, to which the fiber bundles 2 and 3 are subjected by the deformation members 11 and 12, these bundles are bound together and the fiber bundles 2 and 3 which are bound together can be removed from the operational region 14, for example, in the direction of the arrow 18. However, it is also possible to remove the bound fiber bundles from the operational region 14 against the direction of the arrow 17.

In order that deformation forces can have an effect on the fiber bundles 2 and 3 to be bound, it is essential that the width of the gap 14 is smaller at its narrowest point than the total of the diameters $D_1$ or $D_2$ (see FIG. 2) of the fiber bundles 2 and 3 which are to be bound together.

Figure 8:
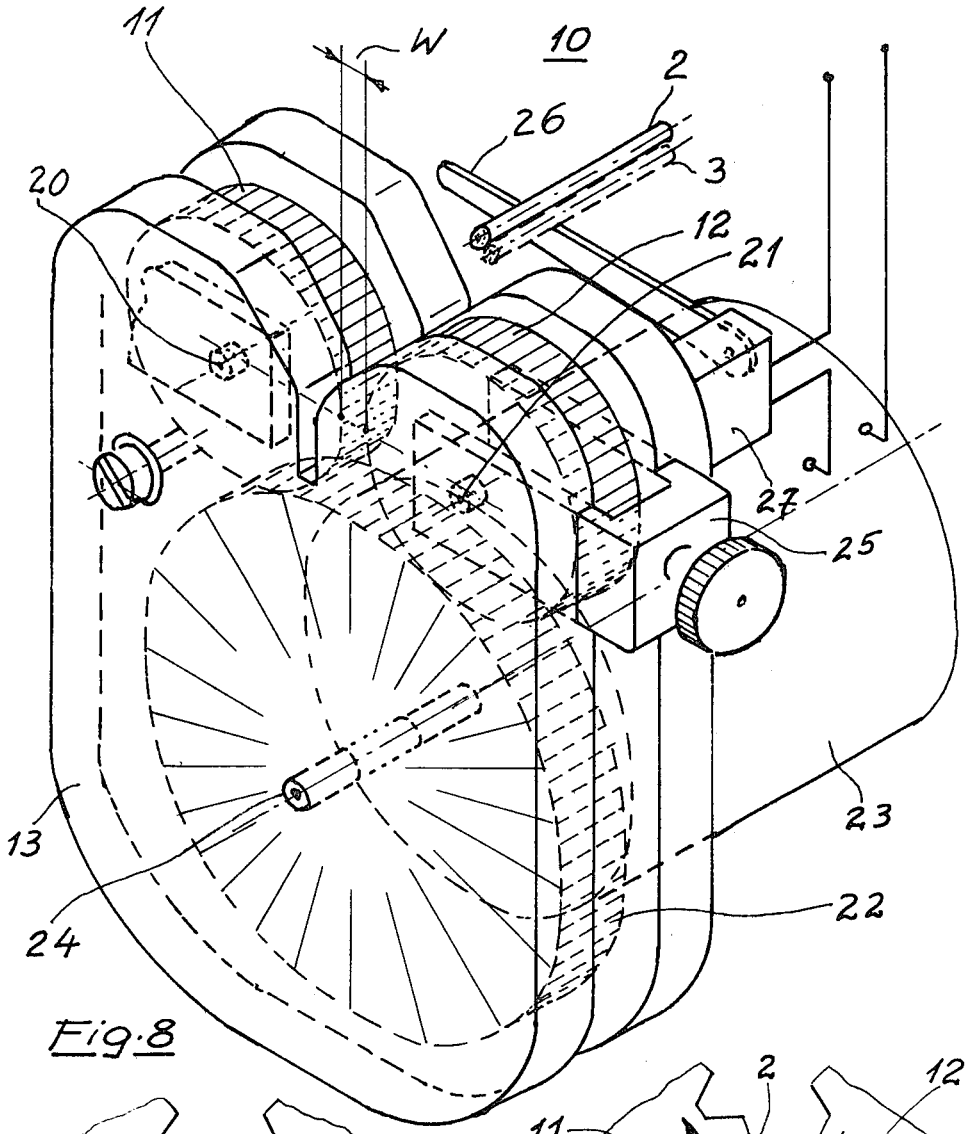
FIG. 8 is a schematic drawing in perspective which illustrates an apparatus for carrying out the method in accordance with the invention.

FIG. 8 schematically illustrates in greater detail an apparatus for carrying out the process in accordance with the present invention. The various parts of the apparatus 10 are installed on a support 13. Two deformation members 11 and 12 are each mounted on an axle 20 or 21 so that they can be rotated through a driving wheel 22. The driving wheel 22 itself is coupled with a drive source 23 through a coupling member 24, for example, a shaft. A small electric motor is, for example, suitable for use as the drive source 23. The deformation members 11 and 12 are rotative forms in the embodiment according to FIG. 8 and at least a part of their surface, for example, their casing surfaces, are profiled. This profile can be a toothing, which has, for example, the same profile as the driving wheel 22. In such a case, both the toothing of the deformation member 11 and also the toothing of deformation member 12 is engaged with the toothing of the driving wheel 22. An adjustable mounting installation 25 is also preferably attached to the support 13, on which one of the deformation members is mounted (in the example of FIG. 8, it is deformation member 12), so that it is movable toward and away from the other deformation member, whereby the width W of the operational region of gap 14 is adjustable.

Figure 28:
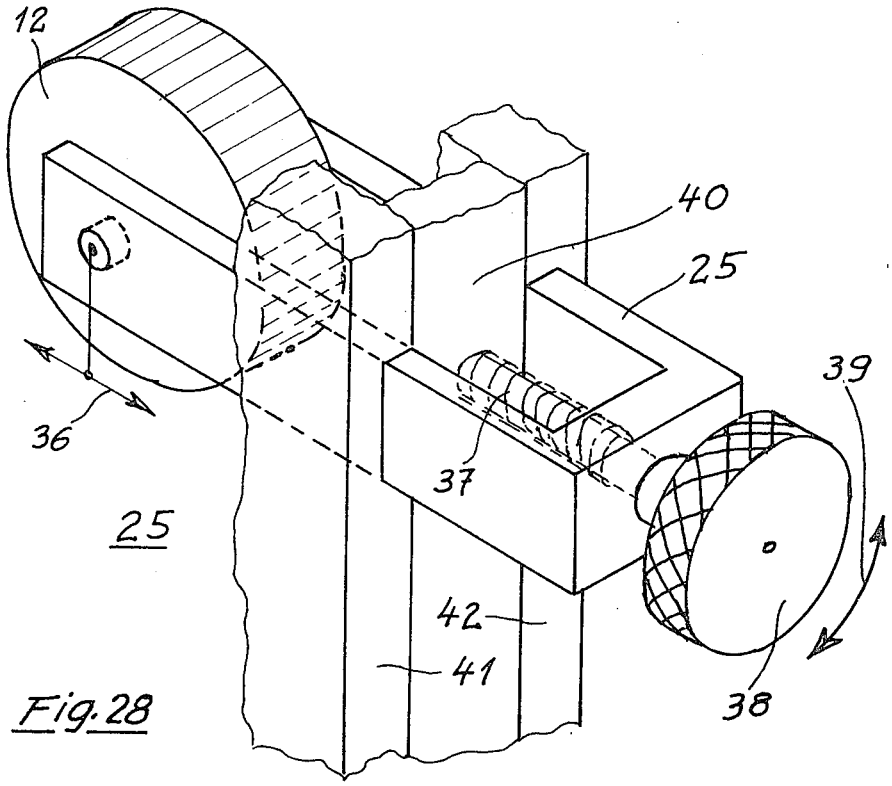
FIG. 28 is a schematic drawing which illustrates a device for adjusting the width of the operational region of the deformation members.

FIG. 28 shows an embodiment of an adjustable mounting installation 25 in which at least one deformation member 12 is mounted so that it can rotate and the mounting installation 25 can be moved transversely in the direction of the double-headed arrow 36 so as to be adjustable in position by means of an adjusting device 37 operated by way of a locking member 38. Some adjustment of the adjusting device 37 can be obtained by turning the locking member 38. The mounting installation 25 is carried in respective slots in two bars 41 and 42, which may form part of the support 13, and a center piece 40 is located between the bars 41 and 42 and is secured thereto in any suitable manner. The mounting installation 25 can be moved in the slots in the bars 41 and 42 by the adjusting device 37, for example, a threaded spindle, which runs through the center piece 40.

It is an advantage to provide at least one movable member 26 in the apparatus 10, as seen in FIG. 8, for at least the partial conveyance and/or tracing of the fiber bundles 2 and 3 to be bound. When introducing the fiber bundles 2 and 3 to be bound, the most advantageous position of the fiber bundles 2 and 3 for the optimum introduction into the operational region of the deformation members 11 and 12 can be ensured, for example, by a slot located at a suitable point along the length of the movable member 26. It is also possible to scan the actual position of the fiber bundles 2 and 3 by means of the movable member 26. The movable member 26 is pivoted by the introduction of the fiber bundles 2 and 3 into the operational region 14 (see FIG. 7) of the apparatus 10, and the movable member, if it is connected with a switching member 27, can operate this member dependent on the position of the fiber bundles to be bound and can thereby temporarily switch the electric motor 23 for the drive source 22 on or off.

In the apparatus 10 of FIG. 8, at least a part of the surface or the casing surface of the deformation members 11 and 12 is toothed and the distance between the axles of the deformation members 11 and 12 is chosen so that their teeth do not come into contact with each other, but are spaced so that they approach each other up to a width W of less than the total of the diameters $D_1$ and $D_2$ of the fiber bundles 2 and 3 to be bound when they are positioned opposite each other at the narrowest point of the operational region 14 (see FIG. 7).

Figure 11:
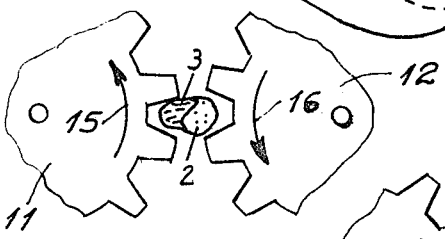
FIG. 11 is a schematic drawing which illustrates the occasional release of the fiber bundles by the spaced deformation members, where the tooth spaced are opposite each other.
Figure 10:
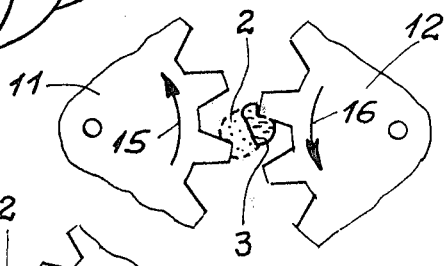
FIG. 10 is a schematic drawing which illustrates the deformation of two fiber bundles by spaced deformation members, where the teeth of the deformation members are meshing.
Figure 9:
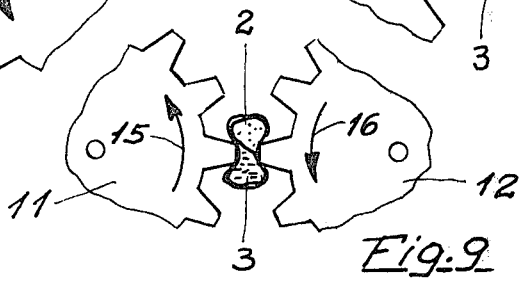
FIG. 9 is a schematic drawing which illustrates the deformation of two fiber bundles by spaced deformation members, the teeth of the deformation members being opposite each other.

It can be seen from FIGS. 9, 10 and 11 how fiber bundles 2 and 3 are deformed under the influence of the deformation members 11 and 12 having such toothed surfaces. FIG. 9 shows the relationship of two teeth exactly opposite each other; FIG. 10 shows the relationship of an intermediate position; and, FIG. 11 shows the relationship of opposite tooth spaces. It can be seen that both the strength and the direction of the forces exerted by the deformation members on the fiber bundles 2 and 3 change continually and that there are both time intervals where there is an influence in terms of force on the fiber bundles 2 and 3 and also time intervals where temporary release of the fiber bundles occurs. The times where force is aplied to the bundles are shown in FIGS. 9 and 10; a time interval involving release of the fiber bundles is shown in FIG. 11.

In order to achieve or to promote certain binding structures, approximately according to FIGS. 3 to 6 or mixed shapes of the same, it has proven to be advantageous to use deformation members with forms of a varying shape in addition to selection of the proper peripheral configuration thereof. FIGS. 12 to 17 show examples of deformation members, all of which have toothed surfaces 27, the teeth running peripherally or transversely.

Figure 12:
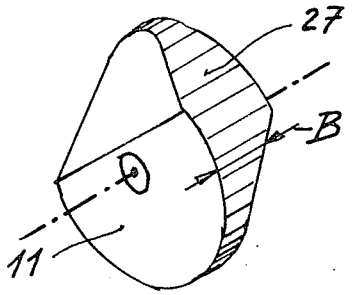
FIG. 12 is a detail drawing which illustrates a deformation member having a periphery of varying width.

FIG. 12 shows a deformation members 11, which is a rotatable body having a profiled peripheral surface. The surface 27 has a varying width B along the circumference of the body. In this regard, the faces of the cylindrical body are cut off along planes inclined relative to its axis, the planes being parallel and spaced by a distance approximately equal to the width of the body.

Figure 13:
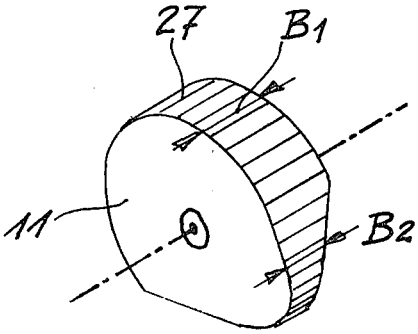
FIG. 13 is a detail drawing which illustrates a deformation member having a periphery which is partially constant and partially variable in width.

FIG. 13 shows a deformation member having a profiled peripheral surface 27, of which the width $B_1$ is constant over a first region of its circumference, and the width $B_2$ varies over another region of the circumference. The portion including the width B2 has the faces thereof cut off by planes which are inclined symmetrically with respect to a vertical plane through the center of the body.

Figure 14:
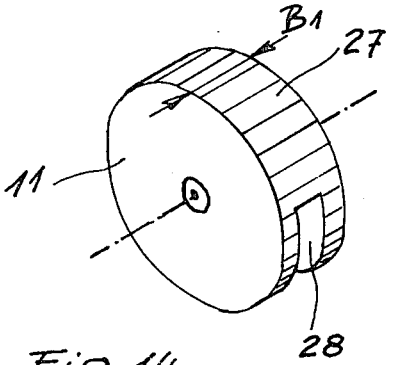
FIG. 14 is a detail drawing which illustrates a deformation member having a periphery comprising a region of constant full width and a region with reduced width.

FIG. 14 shows a deformation member 11 having a profiled surface 27 having a width B1 with a recess 28 in a portion thereof. Only one part of the surface 27 comes into contact with the fiber bundles to be bound. In this regard, the recess 28 reduces the width of the cylindrical surface B1, so that only the shoulders on both sides of the recess 28 come in contact with the fiber bundles. As an example, the recess 28 can be one-half the width of surface B1, so that each shoulder is one-fourth thereof. Similarly, it is possible for the recess 28 to be one-third the width of surface B1. Also, the recess 28 may be displaced to one side of center, so that the shoulders are non-symmetrical.

Figure 15:
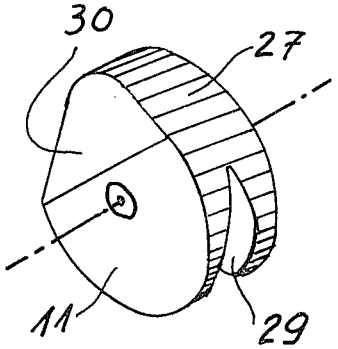
FIG. 15 is a detail drawing which illustrates a deformation member having periphery width variable and constant regions of width.

FIG. 15 shows another embodiment of a deformation member 11 on one side of which there is a wedge-shaped recess 29 and on the other side there is a chamfer 30. The surface 27 has a varying operational width along its circumference due to the chamfer 30 and the recess 29.

Figure 16:
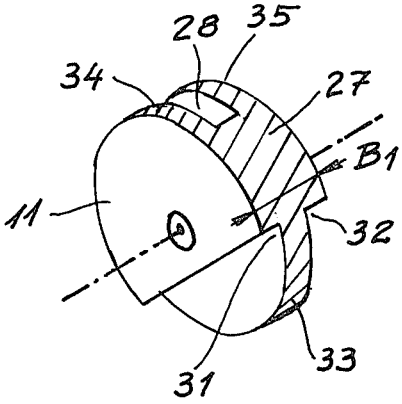
FIG. 16 is a detail drawing which illustrates a deformation member having a periphery made up of a transversely-toothed casing surface, where the casing surface has regions of varying width.

FIG. 16 shows a deformation member 11 which has a profiled surface and a recess 28 which is symmetrical with respect to the center of the deformation member 11 and also has opposite recesses 31 and 32 so that, when in operation, alternate points of the surface 27 having a varying width and position on the surfaces 33, 34 and 35 come into contact with the fiber bundles 2 and 3 to be bound.

Figure 17:
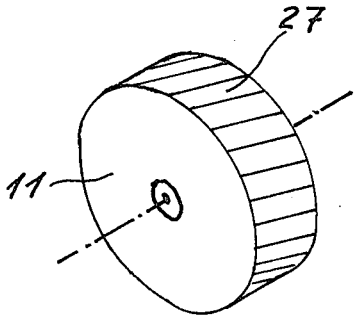
FIG. 17 is a detail drawing which illustrates a deformation member having a periphery which is transversely toothed.

FIG. 17 shows a deformation member 11 which has a casing surface formed with teeth which are inclined with respect to the generatrice of the cylindrical surface. Various degrees of inclination of these teeth are possible to produce various effects.

FIGS. 18 to 25 show deformation members which have peripheral surfaces, each of which are of a different toothed or tooth-like nature. However, it should be noted that the toothing on the peripheral surface of the two deformation members 11 and 12 are never engaged with each other due to the formation of the gap 14 therebetween. Where the form is suitable, the teeth of the deformation members 11 and 12 can engage with the driving wheel 22 (see FIG. 8), if the driving wheel 22 has suitable teeth. Where there is an arrangement as in FIG. 26, that is, the deformation members are driven indirectly by means of the intermediate wheels 43 and 44, the tooth shape can be chosen without any restrictions.

Figures 18, 19, 20, 21, 22, 23, 24, 25, 26, 27:
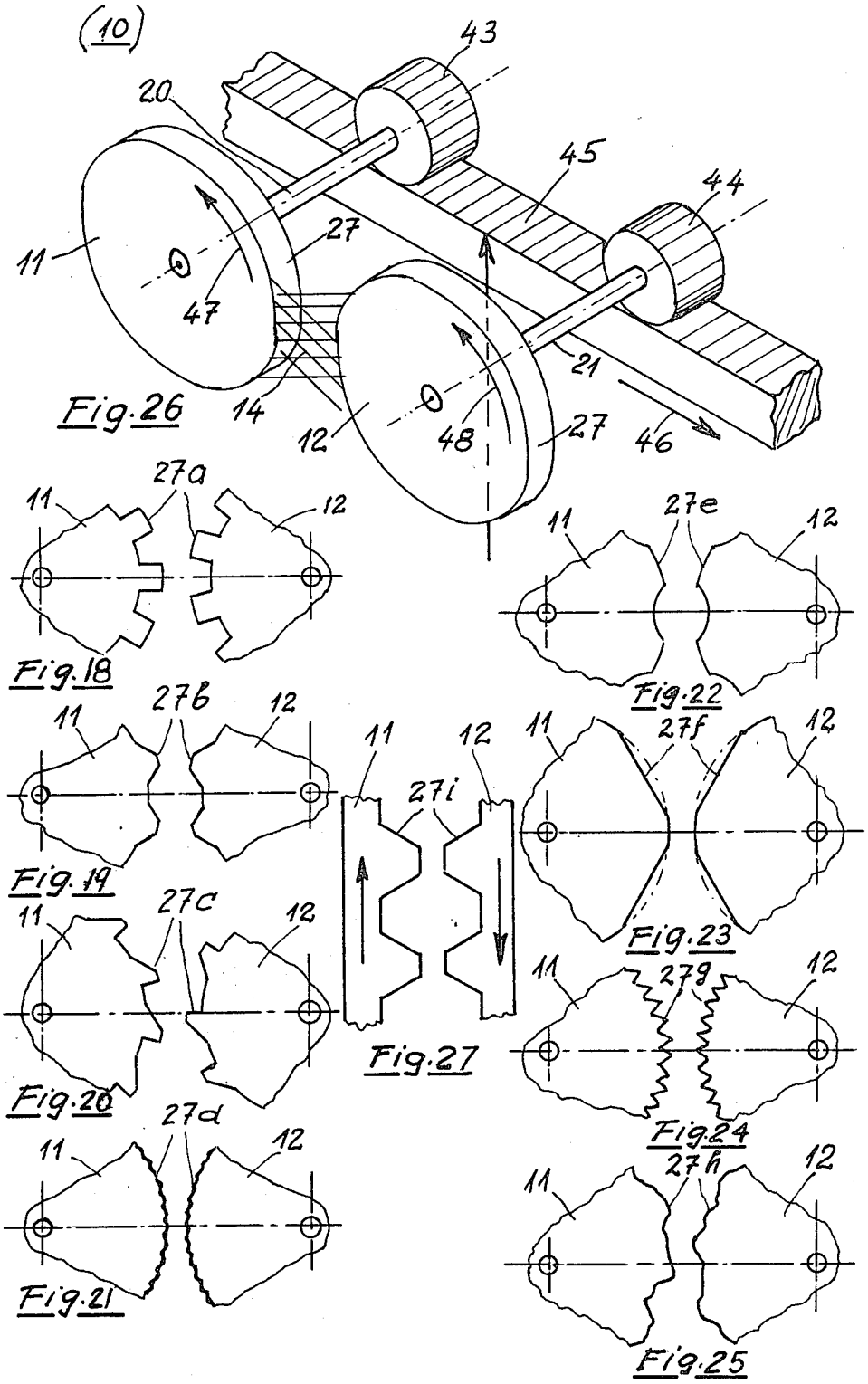
FIGS. 18 to 25 are partial detail drawings of various embodiments showing different configurations of the casing surfaces of the deformation members.
FIG. 26 is a schematic drawing of an apparatus having an indirect drive for the deformation members.
FIG. 27 is a partial detail drawing which schematically illustrates the manner in which deformation members can be moved in a linear direction relative to each other.

FIG. 18 shows deformation members having teeth 27*a* which have a rectangular profile.

FIG. 19 shows deformation members 11 and 12 having teeth 27*b* which have a trapezoidal profile.

FIG. 20 shows deformation members 11 and 12 having saw-tooth shaped teeth 27*c*.

FIG. 21 shows deformation members 11 and 12 having a rib-like profile 27*d* on the casing surface.

FIG. 22 shows deformation members 11 and 12 on the casing surface of which 27*e* there are alternate concave and convex portions.

FIG. 23 shows deformation members 11 and 12, the casing surface 27*f* of which is provided alternately with cylindrical and flat areas.

FIG. 24 shows deformation members 11 and 12, the casing surface 27*g* of which has sharp-edged teeth.

FIG. 25 shows deformation members 11 and 12, the casing surface 27*h* of which has a structure similar to a grinding wheel, the roughness being adapted to the nature of the material of the fiber bundles to be bound.

FIG. 26 illustrates a portion of another embodiment of the apparatus 10 in which the deformation members 11 and 12 have a profiled peripheral surface 27. However, the deformation members 11 and 12 are driven indirectly and surfaces 27 are themselves not engaged with other teeth. In the embodiment shown in FIG. 26, the deformation members 11 and 12 are connected with intermediate wheels 43 and 44 by spindles 20 and 21, respectively, and are driven by a movable rack 45. The rack 45 moves, for example, in the direction of the arrow 46. The intermediate wheels 43 and 44 could, however, also be driven by the driving wheel 22.

FIG. 27 shows an example of deformation members which are formed as bodies which can be moved in a linear direction, and which face each other in a pair having profiled surfaces 27*i*. The fiber bundles to be bound can be passed through between the surfaces 27*i*. Bodies of this kind which are moved in a linear direction, acting as deformation members, can also be moved, for example, by a lever mechanism.

Figure 29:
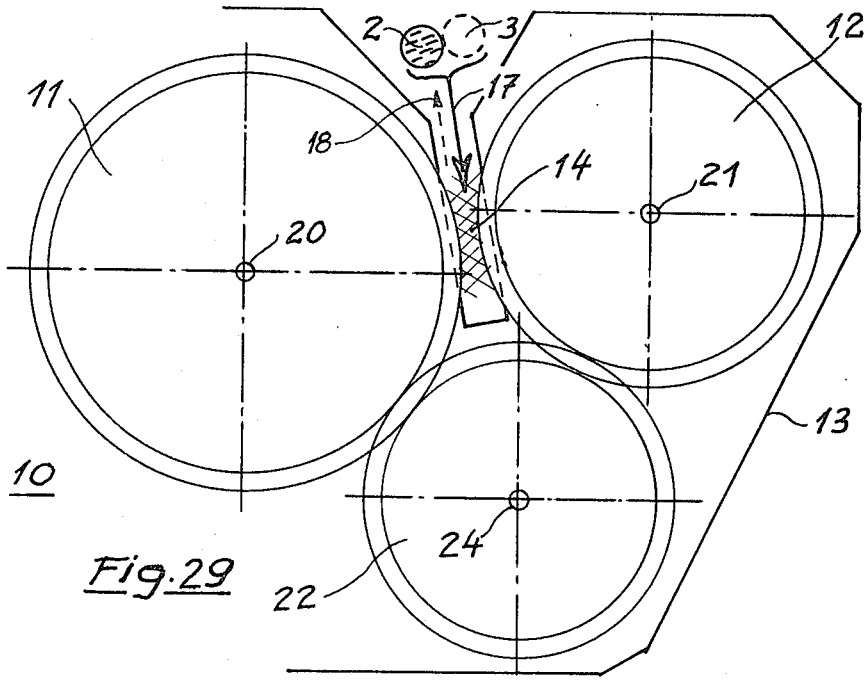
FIG. 29 is a schematic drawing which illustrates an apparatus having deformation members and a driving wheel with varying numbers of teeth.

FIG. 29 is another schematic illustration of an apparatus 10, in which the deformation members 11 and 12 each have a toothed peripheral surface. The members 11 and 12 are both engaged with a driving wheel 22. The deformation members 11 and 12 and/or the driving wheel 22 can have the same or different numbers of teeth. The fiber bundles 2 and 3 which are to be bound together are introduced into the gap 14 in the direction of the arrow 17 and the bound fiber bundles can be removed in the direction of the arrow 18 which is shown by dashes.

Figure 30:
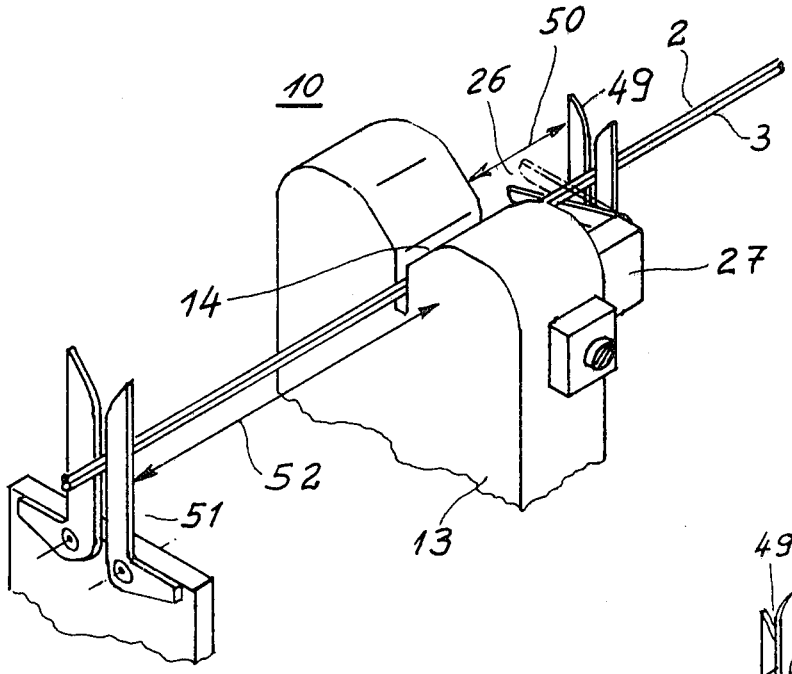
FIG. 30 is a schematic drawing which illustrates the use of guiding devices for the fiber bundles passing through the binding mechanism.

FIG. 30 shows how, with an apparatus 10, guiding devices 49 and 51 can be positioned on both sides of the gap 14 of the deformation members 11 and 12. The first guiding device 49 is positioned here with a first spacing 50 and the second guiding device 51 is positioned with a second spacing 52 from the support 13, these guiding devices 49 and 51 being on opposite sides of the operational region 14.

According to the twisting of the fiber bundles 2 and 3, that is, according to both the number of twists per unit of length and also according to the direction of the twist, there can be a change in the previously-existing twist of the fiber bundles by the effect of the deformation members in the region of the binding 1 to be produced and also in neighboring zones. By a suitable choice of the first spacing 50 or the second spacing 52, this fact can be accommodated and it can thereby be ensured that changes in the twist do not have a detrimental effect or can be levelled out in the neighboring region of the binding 1.

Since the changes of twist can be effected in a differing manner on the left and right of the operational region 14 where there is a given twisting direction of the fiber bundles 2 and 3, allowance can be made for this fact by an uneven choice of the first spacing 50 and of the second spacing 52.

Figure 31:
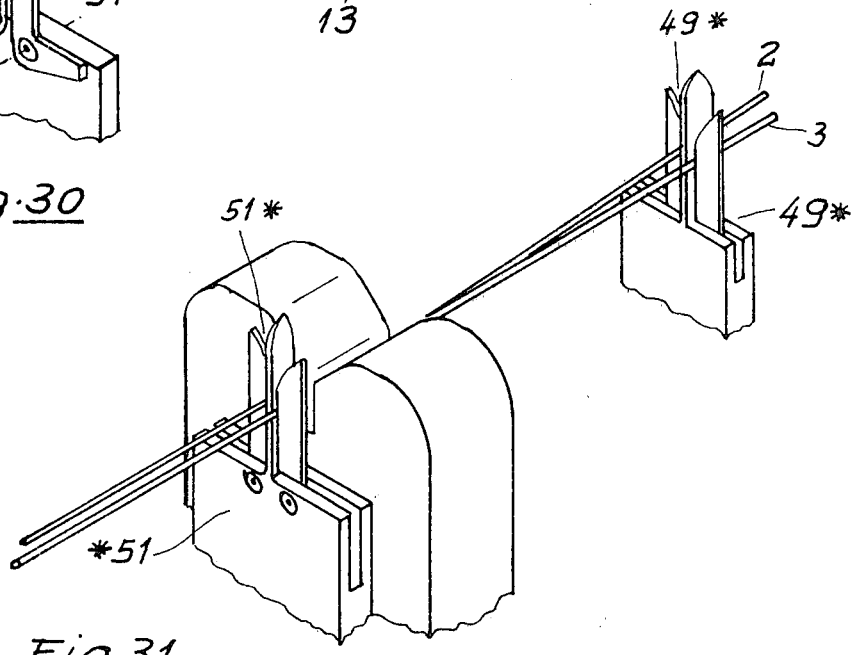
FIG. 31 is a schematic drawing which illustrates another embodiment of a guiding device for the fiber bundles passing through the binding mechanism.

FIG. 31 shows variations 49* and 51* of the guiding devices, which are formed so that the fiber bundles which are to be bound are conveyed while separated from each other.

Figure 32:
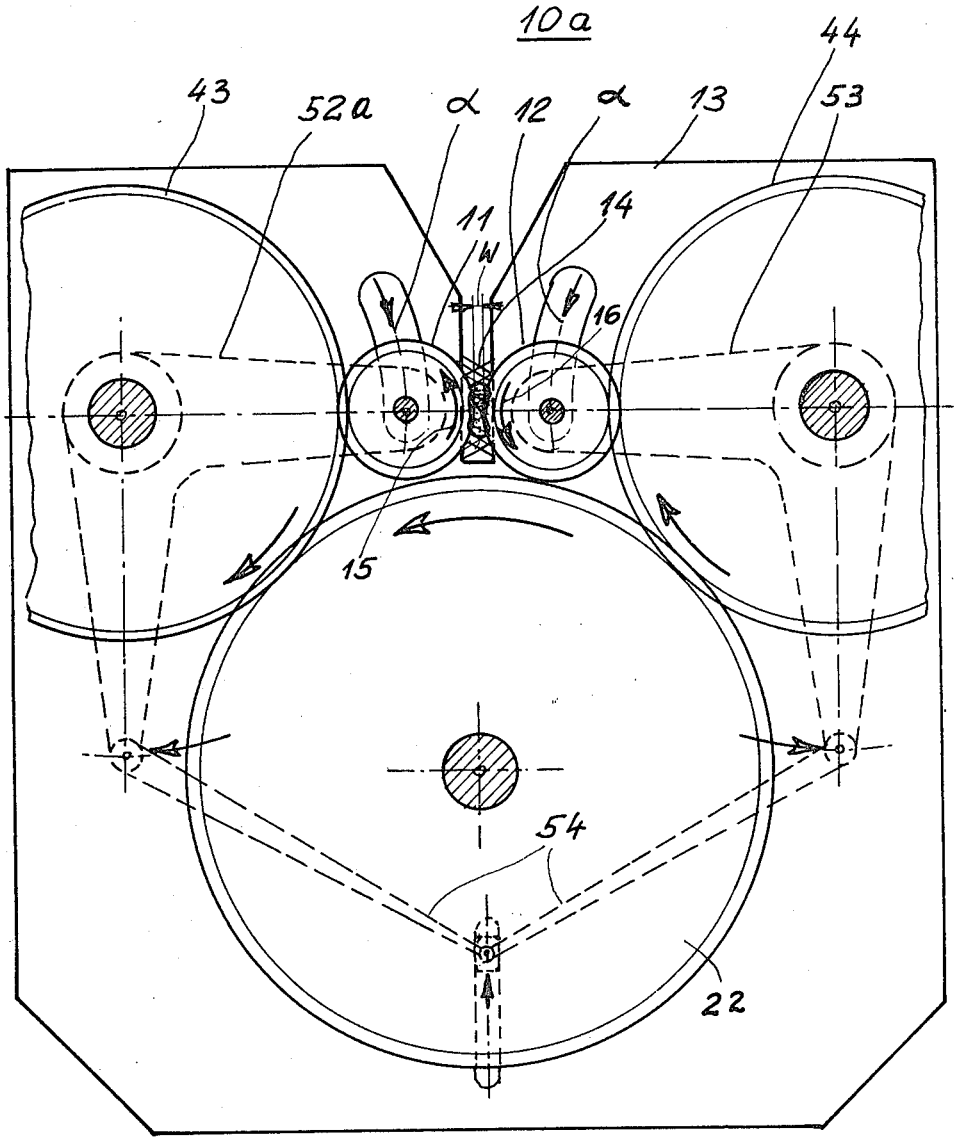
FIG. 32 is a schematic drawing which illustrates another embodiment of the apparatus in accordance with the present invention.

FIG. 32 shows an embodiment 10*a* which is characterized in that the deformation members 11 and 12 are mounted on pivot arms 52*a* or 53 so that they can rotate in the direction according to arrows 15 and 16, and they are driven by the driving wheel 22 through intermediate wheels 43 and 44. The width W of the gap 14 varies according to the size of the pivot angle of the pivot members 52*a* and 53. If the pivot members 52*a* and 53 are operated, for example, by a lever mechanism 54, then the apparatus 10*a* can be brought into the region of the fixed fiber bundles 2 and 3 which are to be bound, where there is a larger width W, without the fiber bundles 2 and 3 already coming into contact with the deformation members 11 and 12. By operating the lever mechanism 54, the deformation members 11 and 12 can then be brought closer together, whereby the deformation of the fiber bundles begins and a binding 1 results. After this has been carried out, the operational region 14 can be opened by the renewed operation of the lever mechanism 54, and the apparatus 10*a* can be drawn away so that the fiber bundles 2 and 3 which are bound together with their binding 1 are freely accessible. An embodiment of the apparatus 10 according to the variation 10*a* is particularly suitable for use in automatic operation.

It has been shown that according to the described methods and by using the described apparatus, binding 1 can be produced which completely fulfills all the practical criteria. It should be noted here that the production of a binding of this type takes place in approximately one second and the complete operational cycle, that is, introducing the fiber bundles, forming the binding and removing the bound fiber bundles, can be carried out within a few seconds. It has also been shown that according to the described process, if the parameters have been chosen in an optimum manner, the bindings which have been produced have a sufficient tearing strength where there is a length L of the binding 1 of approximately the size of the diameter D, which tearing strength is roughly in the region of the tearing strength of one individual fiber bundle or is even stronger. Another advantage of the described bindings is their very high flexibility and the fact that the diameter D of the binding can be chosen to be approximately the same as the original diameter of one of the fiber bundles to be bound. Another advantage of the described binding is in the fact that no foreign materials are required for the winding 4, so that, for example, in the subsequent dyeing no differences are noticeable. Finally, it should also be pointed out that the apparatus 10 required for producing the binding is constructed in a much simpler manner in comparison to automatic knotting apparatus, and thus, it can be produced at a smaller cost. As a consequence of the smaller consumption of energy, it is also very possible to produce a movable or portable apparatus, having, for example, a battery-powered electric motor drive.

The apparatus also has the advantage of being self-cleaning, in that any soiling of the apparatus is avoided in a practical manner by means of a flow of air produced by the apparatus or rather by its movable parts.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are obvious to one of ordinary skill in the art.

What is claimed is:

1. A method for the production of a binding wherein a plurality of fiber bundles are to be bound together, comprising the steps of positioning the fiber bundles so that they are at least approximately parallel to each other and are close together; exerting both thrust as well as tractive and/or pressure forces on at least one part of the circumference of each of the fiber bundles to be bound including subjecting the entirety of the fiber bundles to agitated deformation by means of physical contact with the bundles in order to change the original cross sections and/or structure of the fiber bundles and to release the individual fibers of at least one of the fiber bundles at least partly from their bundle and to displace them so that they finally wind around the fiber bundles to be bound in a manner locked by tension; and then relocating the fiber bundles which are bound by the winding out of the operational region of the deformation operation.

2. A method according to claim 1, wherein at least one operational parameter is adjusted in order to produce the binding for the purpose of promoting the formation of preferred binding structures by a determined choice of such individual parameters.

3. A method according to claim 2, wherein the subjecting of the fiber bundles to agitated deformation is effected by use of spaced deformation members positioned on either side of an operational region through which the fiber bundles pass, and wherein at least one of the following operational parameters is adjusted;

(a) the distance between the fixing points of the fiber bundles which are to be bound;
(b) the tension between the fixed fiber bundles;
(c) the structure of the deformation members producing said agitated deformation;
(d) the mutual distance between said deformation members;
(e) the mutual spatial orientation of said deformation members;
(f) the pressure of said deformation members on the fiber bundles which are to be bound;
(g) the velocity of said deformation members relative to the fiber bundles;
(h) the angled position of said deformation members relative to the fiber bundle;
(i) the passage rate of the fiber bundles to be bound through the operational region of said deformation members;
(j) the duration of movement of said deformation members relative to the fiber bundle;
(k) the passage time of the fiber bundles to be bound through the operational region of said deformation members; and
(l) the duration of the fiber bundles to be bound in the operational region of said deformation members.

4. A method according to claim 1, wherein the fiber bundles which are to be bound are moved through a gap between deformation members by a relative movement between the fiber bundles to be bound and the apparatus and/or the fiber bundles which are to be bound are left temporarily in this operational region.

5. A method according to claim 4, wherein the forces of the deformation members acting on the fiber bundles to be bound are varied in a rapid temporal sequence in their magnitude and/or direction.

6. A method according to claim 5, wherein the time intervals of the influence of the deformation members on the fiber bundles and the time intervals of the release of the fiber bundles in the deformation members are alternated during the passage of time or duration of the fiber bundles to be bound through the operational region of the deformation members.

7. A method according to claim 1, wherein the distribution of the fibers in the bundles is changed at least in portions of the fiber bundles to be bound in comparison with the original distribution before the operation of the deformation members, by selecting a suitable structure of the deformation members and/or the strength and/or the frequency of the operations of the deformation members.

8. A method according to claim 7, wherein fibers belonging to one fiber bundle are intermingled with fibers of the same and/or of another fiber bundle by the effect of the deformation members.

9. A method according to claim 8, wherein the surface and/or the structure of individual fibers of the fiber bundles are changed so that they increase in their adhesion due to the effect of the deformation members, and the adhesion of fibers to one another in the region of the binding, which is to be obtained, is increased in comparison to parts of the fiber bundles which are not involved in the operational region of the deformation members.

10. A method according to claim 1, wherein the winding, which is locked by the tension of the binding point leads to an increase of the compression of the individual fibers in the winding region and thereby leads to an increased adhesion of the individual fibers to each other and to an increased tearing strength of the binding.

11. A method according to claim 10, wherein individual fibers of the fiber bundles to be bound are changed in their structure due to the operation of the deformation members so that they tend to entwine with each other.

12. An apparatus for producing a binding from a plurality of fiber bundles comprising at least two deformation members which are movably mounted on a support, at least one part of the surface of said deformation members being profiled; means for moving said deformation members relative to each other in an operational region so that the profiled surfaces of said deformation members move in opposite directions in spaced relationship while engaging the fiber bundles to be bound; means for conveying the fiber bundles to be bound to the operational region; and means for moving the bound fiber bundles out of the operational region.

13. An apparatus according to claim 12, wherein the operational region between said deformation members has a width which is smaller at its narrowest point than the total of the diameters of the fiber bundles which are to be bound.

14. An apparatus according to claims 12 or 13, wherein the deformation members are rotatable bodies mounted on a spindle and rotatable by a driving wheel coupled with a mechanical drive through a coupling member.

15. An apparatus according to claim 13, wherein at least one of the deformation members is adjustably mounted so that an adjustment of the width of the operational region is possible.

16. An apparatus according to claim 12, wherein at least one movable member is provided for the partial conveyance of the fiber bundles to be bound.

17. An apparatus according to claim 16, wherein the movable member is connected with a switching member in order to operate the switching member dependent on the position of the fiber bundles to be bound.

18. An apparatus according to claim 14, wherein at least one part of the surface of the deformation members is toothed and the distance between the spindles of the deformation members is such that their teeth do not come into contact with each other but when they are placed opposite each other at the narrowest point of the operational region, they approach each other up to a width of less than the total of the diameters of the fiber bundles to be bound.

19. An apparatus according to claim 12, wherein at least one deformation member is a rotatable body having a profiled surface which has a varying width along its circumference.

20. An apparatus according to claim 12, wherein at least one deformation member is a rotatable body having a profiled surface which is constant in width over a first region of its circumference and varies in its width over another region of the circumference.

21. An apparatus according to claim 12, wherein at least one deformation member is a rotatable body having a profiled surface including a recess at which only one part of the width of the profiled surface comes into contact with the fiber bundles to be bound.

22. An apparatus according to claim 12, wherein at least one deformation member is a rotatable body having a profiled surface, one side of the deformation member having a wedge-shaped recess, the member also having a chamfer so that over the remainder of the profiled surface there is a varying operational width.

23. An apparatus according to claim 12, wherein at least one deformation member is a rotatable body and wherein on a first part of the circumference of said one deformation member there is a recess which is symmetrical to the center plane of the deformation member and another part of the circumference the deformation member has other recesses which are opposite each other, so that, when operating, alternate points of the profiled surface having a varying width come into contact with the fiber bundles to be bound.

24. An apparatus according to claim 23, wherein the profiled surface is formed by teeth running peripherally.

25. An apparatus according to claim 12, wherein at least one deformation member is rotatably mounted in a mounting installation which is movable transversely to the direction of the fiber bundles to be bound and is adjustable by means of an adjusting device.

26. An apparatus according to claim 12, wherein the deformation members have a toothed surface, each deformation member being engaged with a common driving wheel.

27. An apparatus according to claim 26, wherein the deformation members and the driving wheel have a different number of teeth.

28. An apparatus according to claim 12, wherein the deformation members are indirectly drivable, their profiled surfaces being not engaged with other teeth.

29. An apparatus according to claim 28, wherein the deformation members can be driven by a movable rack through spindles and intermediate wheels which are connected with the spindles.

30. An apparatus according to claim 28, wherein the deformation members can be driven by a driving wheel through spindles and intermediate wheels which are connected with the spindles.

31. An apparatus according to claim 28, wherein the deformation members have surfaces of a tooth-like profile.

32. An apparatus according to claim 28, wherein the profiled surfaces have a structure which has a rectangular profile.

33. An apparatus according to claim 28, wherein the profiled surfaces have a structure which has a trapezoidal profile.

34. An apparatus according to claim 28, wherein the profiled surfaces have a structure which has a saw-tooth profile.

35. An apparatus according to claim 28, wherein the profiled surfaces have a structure which has a rib-like profile.

36. An apparatus according to claim 28, wherein the profiled surfaces have alternately concave and convex portions.

37. An apparatus according to claim 28, wherein the surfaces are provided alternately with cylindrical and flat areas.

38. An apparatus according to claim 28, wherein at least one deformation member has a toothed surface, at least parts of the teeth having sharp edges.

39. An apparatus according to claim 28, wherein at least one deformation member has a rough surface.

40. An apparatus according to claim 12, wherein the deformation members are bodies which can be moved in a linear direction and face each other as a pair having profiled surfaces arranged so that the fiber bundles which are to be bound can be passed between them.

41. An apparatus according to claim 12, wherein a first guiding device for the fiber bundles which are to be bound is located in a first spacing on one side of the operational region of the deformation members and a second guiding device is located in a second spacing on the other side of the operational region of the deformation members.

42. An apparatus according to claim 41, wherein the first spacing and the second spacing are at least approximately of the same length.

43. An apparatus according to claim 41, wherein the second spacing is longer than the first spacing.

44. An apparatus according to claim 41, wherein at least one of the guiding devices is formed so that the fiber bundles which are to be bound are fed in separately.

45. An apparatus according to claim 12, wherein the deformation members are positioned so that they can rotate on pivots and are driven by a driving wheel through intermediate wheels, the operational region and its width ranging in dependence on the pivot angle of the pivot members.

* * * * *